US006308031B1

(12) United States Patent
Hiroe

(10) Patent No.: US 6,308,031 B1
(45) **Date of Patent: *Oct. 23, 2001**

(54) IMAGE FORMING APPARATUS

(75) Inventor: Nobuhiro Hiroe, Kashiwazaki (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/322,618

(22) Filed: May 28, 1999

(30) Foreign Application Priority Data

May 29, 1998 (JP) ..... 10-148680

(51) Int. Cl.[7] ..... G03G 15/00
(52) U.S. Cl. ..... 399/167
(58) Field of Search ..... 399/159, 162, 399/164, 165, 167, 302, 307, 308

(56) References Cited

U.S. PATENT DOCUMENTS

| | | | | |
|---|---|---|---|---|
| 5,421,255 | * | 6/1995 | Kryk | 399/162 |
| 5,778,287 | * | 7/1998 | Yu | 399/167 |
| 5,864,730 | * | 1/1999 | Budnik et al. | 399/159 X |
| 5,918,091 | * | 6/1999 | Saeki | 399/162 |
| 5,970,281 | * | 10/1999 | Park . | |

FOREIGN PATENT DOCUMENTS

| | | |
|---|---|---|
| 2-284181 | 11/1990 | (JP) . |
| 5-45959 | 2/1993 | (JP) . |
| 5-224571 | 9/1993 | (JP) . |
| 5-341589 | 12/1993 | (JP) . |
| 6-301318 | 10/1994 | (JP) . |
| 9-212007 | 8/1997 | (JP) . |

* cited by examiner

*Primary Examiner*—Sandra Brase
(74) *Attorney, Agent, or Firm*—Ostrolenk, Faber, Gerb & Soffen, LLP

(57) ABSTRACT

In an image forming apparatus using an electrophotographic technique and having an endless belt-shaped photosensitive body for transferring images, a mechanism is provided to maintain the photosensitive body at a constant transfer speed over its entire length irrespective of the effects of various devices in contact with it. A driving roller drives the photosensitive body by contacting its rear surface. One or more guide rollers are also in contact with the rear surface of the photosensitive body for guiding it in conjunction with the driving roller. A transmission such as a belt and pulley or gear mechanism transmits driving force from the driving roller to one or more of the guide rollers. When at least two guide rollers are provided, one is disposed between and above the driving roller and the second guide roller. The driving roller and the second guide roller are so disposed that the portion of the photosensitive body between them lies in a horizontal plane.

5 Claims, 4 Drawing Sheets

IMAGE FORMING APPARATUS

BACKGROUND OF THE INVENTION

1. Field of the Invention

The present invention relates to an image forming apparatus, and particularly relates to an image forming apparatus having a belt-shaped photosensitive body.

The present invention is based on Patent Application No. Hei 10-148680 filed in Japan, the content of which is incorporated herein by reference.

2. Background Art

In general, an image forming apparatus of the kind to which this invention relates produces visible images with toner by developing latent images formed in a photosensitive body by the electrophotographic process. These visible images are transferred and fixed by a fixing means from the photosensitive body to a recording medium to form images.

In such image forming apparatuses, it is necessary that the images developed by the photosensitive material be faithful to the latent images, and that transfer from the photosensitive body to the transfer means or to the recording medium be performed without displacement of the images.

In particular, in the case of forming color images by overlapping a plurality of monochromatic images, and in the case of forming compiled images in which drawings, images and maps are attached, where it is necessary to overlap various color images or to insert composite images at the designated position. In such applications, it is necessary to maintain the transfer speed of the belt-shaped photosensitive body constant everywhere on the belt-shaped photosensitive body surface.

When a new latent image is superposed on an already formed image, if the position of the new image is shifted from the required position, good images cannot be obtained.

Moreover, when the belt-shaped photosensitive body is formed in a cylindrical shape, an important requirement is that the surface of the belt-shaped photosensitive body can transfer without causing local fluctuations in the transfer speed, and that the movement of the belt can synchronize with the other elements such as the recording medium.

In, for example, Japanese Patent Application, First Publication No. Hei 5-281810, a technique was proposed to provide a pulley and a belt on the cylindrical belt-shaped photosensitive body which is driven by a driving roller and the resist roller (paper feeding roller), in order to eliminate speed differences between the rotation of the cylindrical belt-shaped photosensitive body and the rotation of the resist roller. Japanese Patent Application, First Publication No. Hei 7-295398 discloses a technique to transfer a driving force from one driving source by means of a series of gears including an eccentric gear for equalizing the peripheral velocities of gears, in order to prevent discrepancies between the rotating speed of the cylindrical belt-shaped photosensitive body and the transfer speed of the transfer belt.

However, when the belt-shaped photosensitive body is used, it is difficult to ensure equal velocity over the whole surface of the belt-shaped photosensitive body, because various guide rollers and fixing means are in contact with the belt-shaped photosensitive body.

When forming a color image by overlapping a plurality of monochromic images, and when forming a compiled image by incorporating color images, graphs, and photographs, these compiled images must be aligned precisely, because displacements of respective objects cannot be allowed. If displacements occur, the obtained images will show color distortion, uneven color, and banding, and be of the low image quality.

Particularly, when the belt-shaped photosensitive body is used, it is preferable to equalize the transfer speed of the belt-shaped photosensitive body over the whole length of the phostosensitive belt by a single driving force, because it is difficult to synchronize a plurality of independent driving sources.

As described hereinabove, when an endless belt type photosensistive belt is used, it is difficult to equalize the transfer speed of the belt-shaped photosensitive body by a single driving source, and to provide an image forming apparatus which is capable of forming images with a high image quality, and this problem hinders the use of endless belt-type photosensitive bodies.

Accordingly, the objects of the present invention are to improve the convenience of the conventional apparatus and to provide an image forming apparatus comprising a driving roller which is in contact with the rear surface of the belt-shaped photosensitive body, one or more guide rollers for guiding the belt-shaped photosensitive body together with the driving roller, and a transmission means for transmitting the driving force of the driving roller directly to at least one of the guide rollers, wherein the image forming apparatus is capable of maintaining the transfer speed of the belt-shaped photosensitive body constant over its whole length and, therefore, it is capable of forming images of excellent quality.

At the same time, it is also an object of the present invention to provide a power-saving type image forming apparatus which is capable of transmitting the driving force of the driving roller efficiently by arranging the guide rollers, photosensitive body, and driving rollers in a characteristic manner for excluding the effects of these elements on the transfer speed of the belt-shaped photosensitive body.

SUMMARY OF THE INVENTION

In order to attain the above objectives, the first aspect of the present invention provides an image forming apparatus comprising an endless belt-shaped photosensitive body, an electrifier for electrifying said photosensitive body, an exposure device for forming electrostatic latent images on the electrified photosensitive body, a development device for forming visible images based on said electrostatic latent images, and a fixing device for fixing said visible images on the recording medium. The image forming apparatus further comprises: a driving roller for driving rotation by contacting with the rear surface of said photosensitive body; a plurality of guide rollers for guiding said photosensitive body together with said driving roll; and a transmission means for transmitting the rotation force of the driving roller to a designated guide roller.

The photosensitive body of the present invention is shaped in the form of an endless belt, which has a specified sensitivity and wear resistance. The photosensitive body of the present invention is manufactured from a material selected from the group of ZnS, CdS, Se-alloys, OPC (organic photosensitive body), amorphous Si, and the like.

The belt-shaped photosensitive body forms an endless belt, and the endless belt is rotatively transferred, while being supported by a driving roller and at least one guide roller.

The driving roller, driven by a driving source such as a motor, transfers the photosensitive body. The guide roller guides the transfer of the photosensitive body and is driven following the driving roller.

Conventionally, the photosensitive body is transferred only by the rotation of the driving roller. However, the present invention also provides a transmission which couples rotating force from the driving roller to the guide roller. The transmission means may be a mechanism using a belt or a mechanism using a gear.

According to the second aspect, the present invention provides an image forming apparatus operated by the principle of the electrophotography, similar to the first aspect of the present invention. The image forming apparatus according to the second aspect is provided with a driving roller for driving the rotation of the photosensitive body by contact with the rear surface of said photosensitive body; guide rollers for guiding said photosensitive body together with said driving roll; and a belt mechanism for transmitting the rotation force of the driving roller to a designated guide roller, provided between said driving roller and said guide roller.

The rear surface of the photosensitive body indicates the rear surface of the surface on which the latent images are produced. A belt mechanism for transmitting the driving force from the driving roller to the designated guide rollers is installed in order to drive the rotation of the photosensitive body.

This belt mechanism makes the guide roller rotate at the same rotation speed as the driving roller, so that the rotations of the driving roller and the guide roller are synchronized. Accordingly, the transfer speed of the photosensitive body transferred by the driving roller becomes the same as that of the photosensitive body transferred by the designated guide roller.

According to a third aspect of the present invention, wherein said belt mechanism is comprised of a pulley formed coaxially on the rotation axis of said driving roller, a pulley formed coaxially on the rotation axis of said guide roller driven following the rotation of the driving roller, and a belt laid on those two pulleys.

The pulley is a belt wheel on which the belt is laid. The contact surface of the pulley with the belt may be provided with protruded or recessed portions, or a member made of a material with a high friction coefficient.

Such a belt mechanism comprising the pulleys and the belt reliably transmits the rotative driving force to the designated guide roller, which provides an effect equal to that of providing a driving source to the guide roller. The rotation speeds of the driving roller and the guide roller are equalized by such a mechanism. By using a driving roller and guide roller with the same diameter, the rotation speed of both rollers becomes the same.

According to a fourth aspect of the present invention, a timing belt mechanism is used as said belt mechanism defined in the second aspect.

The timing belt mechanism is comprised of a pulley with teeth and grooves at even intervals and a belt with grooves at the back surface for engaging with the teeth of the pulley.

Such a timing belt mechanism makes it possible to accurately transmit the rotative driving force of the driving roller through the grooves mounted on the back surface of the endless belt and the teeth of the gear formed at the rotation axis of the guide roller. Accordingly, it is possible to equalize the rotation speed of the driving roller and the rotation speed of the guide roller. Furthermore, the rotative driving force generated by one driving source can be transmitted simultaneously to the driving roller and the guide roller, so that the transfer speed of the photosensitive body is also equalized.

By adopting the timing belt mechanism, the rotation speeds of both the driving roller and the guide roller are equalized accurately, and the transfer speed of the photosensitive body transferred by the guide roller is made equal to the transfer speed of the photosensitive body transferred by the guide roller. Thereby, the driving force generated by one driving source can be transmitted simultaneously to the driving roller and the guide roller such that the photosensitive body as a whole can be transferred at the same speed.

According to a fifth aspect of the present invention, the first guide roller of the two guide rollers is disposed horizontally with respect to the driving roller, and the second guide roller is disposed between said driving roller and the first guide roller such that the distance from the second guide roller to the first guide roller coincides with the distance from the second guide roller to the driving roller.

The endless belt-shaped photosensitive body is supported and transferred by one or more guide rollers in addition to the driving roller. When two guide rollers are used, the first guide roller is disposed in the same horizontal plane as the driving roller (by disposing the axis in parallel with that of the driving roller), and the second guide roller is disposed between said driving roller and the first guide roller such that the distance from the second guide roller to the first guide roller coincides with the distance from the second guide roller to the driving roller. Such an arrangement of rollers provides a wide horizontal area of the photosensitive body for arranging a plurality of elements such as a developing device as well as providing stable transfer of the photosensitive body.

When such an arrangement is observed from the side, the driving roller and two guide rollers form an isosceles triangle.

It is possible to provide additional guide rollers for increasing the support points of the photosensitive body.

When another guide roller is disposed between the driving roller and the first guide rollers, the contact area of the second guide roller with the photosensitive body may be smaller than the contact area of the first guide roller. In that case, the photosensitive body may tend to slip. Thus, when the driving force of the driving roller is transmitted by the photosensitive body, the transfer speed of the photosensitive body transferred by the guide roller changes with that of the photosensitive body transferred by the driving roller due to the difference in contact area.

In order to improve the above situation, a transmission such as a belt mechanism composed of a pulley and a belt, or a timing belt mechanism is provided between the driving roller and the guide roller having the small contact area with the photosensitive body. Accordingly, it is possible to eliminate the change of the transfer speed of the photosensitive body by transmitting the driving force of the driving roller to a guide roller which does not have sufficient contact area.

According to a sixth aspect of the present invention, two guide rollers are provided leaving a predetermined space, and two belt mechanisms are provided for respectively transmitting the rotation force of the driving rollers to said two guide rollers.

The transfer speed of the photosensitive body is equalized by increasing the number of guide rollers which directly receive the driving force of the driving roller. The driving roller and the guide roller connected with the driving roller by the belt mechanisms transfer the photosensitive body at the same transfer speed as the driving roller.

DESCRIPTION OF THE PREFERRED EMBODIMENT

Figure 1:
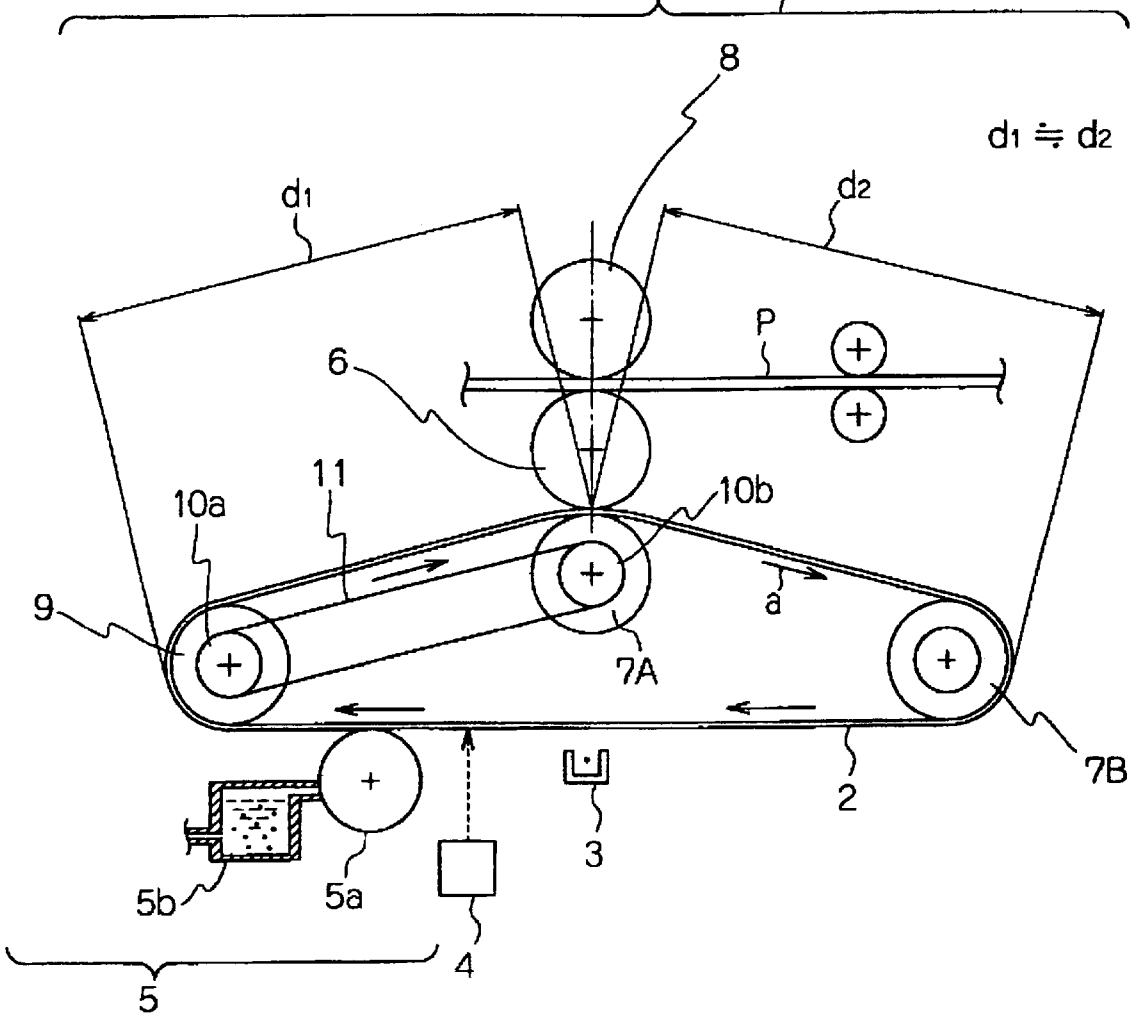
FIG. 1 is a cross sectional view showing the belt-shaped photosensitive body in an image forming apparatus according to an embodiment of the present invention.

Hereinafter, preferred embodiments of the present invention will be described with reference to the attached drawings. FIG. 1 shows a cross sectional view of an image forming apparatus 1 according to an embodiment of the present invention.

The image forming apparatus 1 is provided with an endless belt-shaped photosensitive body 2, an electrifier 3, an exposure device 4 for forming electrostatic latent images on the belt-shaped photosensitive body 2, a development roller 5*a* for producing visible images based on the electrostatic latent images, a toner feeder 5*b* for feeding the toner used for forming the visible images, and a fixing device for transferring the visible images formed on the belt-shaped photosensitive body 2 to a recording medium P. The fixing device shown in FIG. 1 comprises an intermediate transfer roller 6, and a fixing roller 8 for fixing the visible images which are transferred from the intermediate roller 6 to the recording medium P.

The image forming apparatus comprises a driving roller 9 for driving the rotation of the belt-shaped photosensitive body 2 by being in contact with the rear surface thereof, and a plurality of guide rollers 7A and 7B for guiding the belt-shaped photosensitive body together with the driving roller 9, and a belt mechanism for transmitting the driving force of the driving roller 9 to a prescribed guide roller 7A.

This belt mechanism is constructed by a pulley 10*a* disposed in a coaxial relation with the driving roller 9, a pulley 10*b* disposed in a coaxial relation with the rotating axis of the specified guide roller 7A driven by the driving roller 9, and a belt 11 connecting these two pulleys.

The rotating force of the driving roller 9 is transmitted to the pulley 10*a* through the pulley 10*a* and the belt 11. The guide roller 7A on the same axis as the pulley 10*b* is rotated by the same driving force as that of the driving roller 9.

Next, the elements which constitute a first preferred embodiment of the present invention will be described.

The belt-shaped photosensitive body 2 has a predetermined sensitivity and wear-resistance, and the belt-shaped photosensitive body 2 is made of ZnS, CdS, Selenium alloys, OPC (organic photosensitive material), amorphous Si, and other photosensitive materials. The belt-shaped photosensitive body 2 is formed as an endless belt, and this endless belt moves in the direction of "a" supported and guided by at least one pair of guide rollers 7A and 7B.

The electrifier 3 charges the belt-shaped photosensitive body 2 to constant initial potential. The exposure device 4 exposes the belt-shaped photosensitive body to various light sources such as a Laser, LED or a light source through a liquid crystal based on the image data. The electrostatic latent images formed on the belt-shaped photosensitive body 2 are converted into visual images by the applied toner in conjunction with development roller 5*a*

The toner feeder 5*b* receives toner, and when necessary, feeds a required amount of toner to the development roller 5*a*. The embodiment illustrated employs liquid toner, i.e., the developer used in the present image forming apparatus 1 is a dispersion of toner in a carrier liquid. Any toner in the form of a powder or liquid can be used.

The guide roller 7A supports the belt-shaped photosensitive body from the rear surface to maintain the tension of the belt-shaped photosensitive body and to guide the traveling of the belt-shaped photosensitive body.

Figure 2:
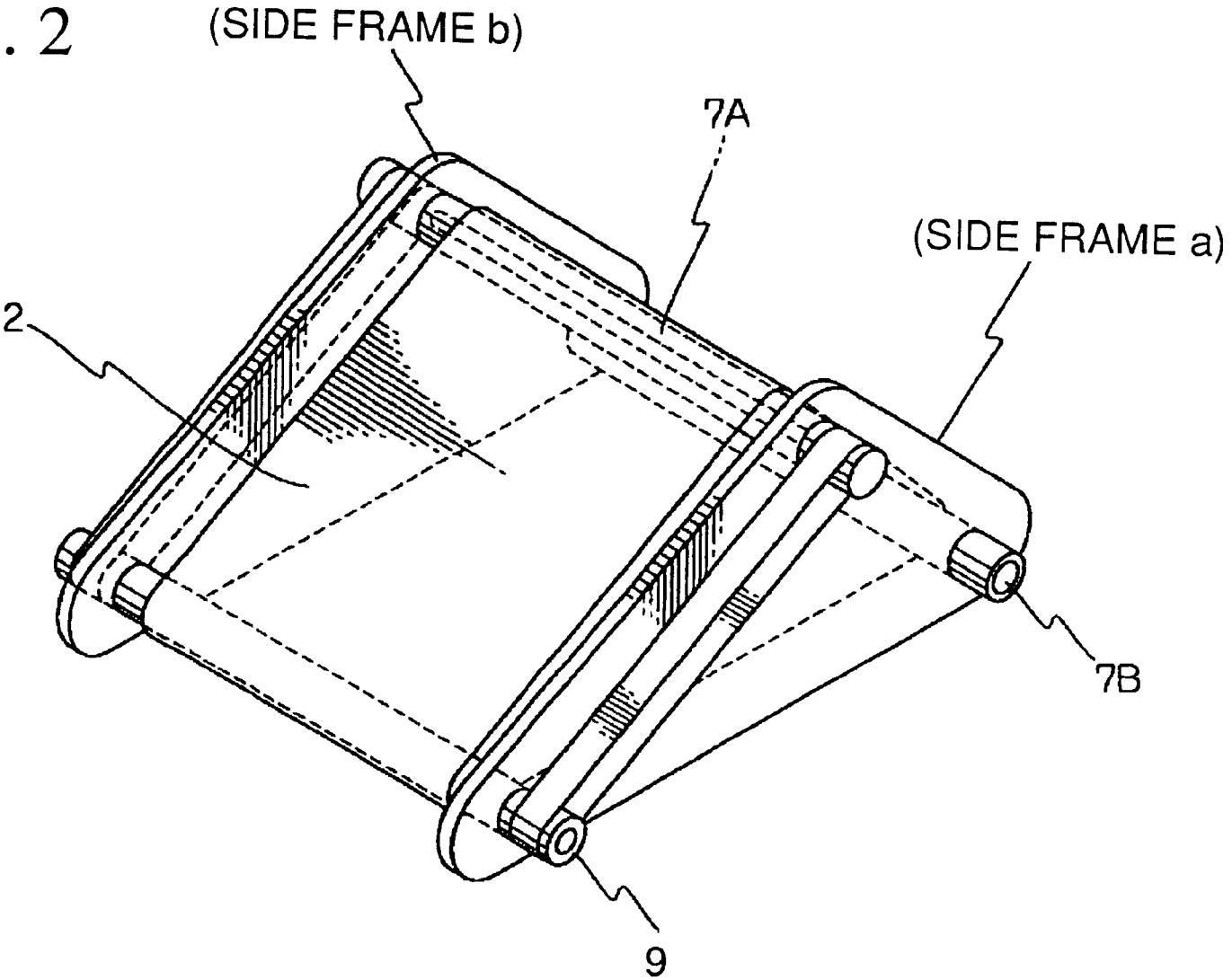
FIG. 2 is a perspective view of the belt-shaped photosensitive body in the image forming apparatus according to an embodiment of the present invention.

The construction of the driving roller 9, the guide rollers 7A, and the belt-shaped photosensitive body 2 are shown in detail in FIG. 2.

The belt-shaped photosensitive body 2 is formed into an endless belt, and stretched at a fixed tension by the driving roller 9 and guide rollers 7A and 7B. The driving roller 9 has a rotation driving portion for driving the belt-shaped photosensitive body 2.

When two guide rollers 7A and 7B are employed one guide roller 7B is disposed in the same horizontal plane driving roller 9 (the guide roller 7B is arranged horizontally and its axis is in parallel with the driving roller 9). Furthermore, the other guide roller 7A is positioned relative to the driving roller 9; the rotating axis of the guide roller 7A is disposed in parallel with that of the driving roller 9 such that the length of the belt-shaped photosensitive body 2 (d1) between the other guide roller 7A to the driving roller 9 is identical with the length of the belt-shaped photosensitive body 2 (d2) between the other guide roller 7A to one guide roller 7B (refer to FIG. 1).

Practically, the belt-shaped photosensitive body 2 is stretched by disposing the driving roller 9 and two guide rollers to form a triangle, preferably an isosceles triangle, in which a line connecting the driving roller 9 and one guide roller 7B forms the base, and a line connecting the driving roller 9 and one of the guide rollers 7A disposed at the top of the triangle, and another line connecting the top guide roller 7A and the guide roller 7B form the side lines of the triangle. The endless belt-shaped photosensitive body 2 travels while being held under a constant tension by disposing the driving roller 9 and a plurality of guide rollers 7A and 7B at optimum positions in response to the length of the endless belt-shaped photosensitive body 2.

Such a disposition of the rollers provides sufficient horizontal space over which the photosensitive body 2 is in contact with the development roller 5*a,* and ensures the stable transfer of the belt-shaped photosensitive body 2 while it is being tensioned. In addition, since it is possible to reduce the width of the belt-shaped photosensitive body 2, this disposition of the rollers contributes to the size reduction of the image forming apparatus.

The disposition of rollers can also eliminate the effects of the fixing device on the stable transfer of the belt-shaped photosensitive body 2 when a fixing device such as the intermediate transfer roller 6 is in contact with the guide roller 7A through the belt-shaped photosensitive body 2.

On both sides, a side frame "a" and a side frame "b" are provided for guiding the transfer path of the belt-shaped photosensitive body 2. Here, the number of guide rollers 7A and 7B, their disposition, and the physical relationship to the driving roller 9 are determined appropriately, taking the size of the image forming apparatus and the length of the belt-shaped photosensitive body into consideration.

Hereinafter, the belt mechanism will be explained.

According to the present embodiment, the belt mechanism is constructed by a pulley 10*a* mounted in a coaxial relation with the rotating axis of the driving roller 9, a pulley

10*b* mounted in a coaxial relation with the rotating axis of the guide roller 7A which is driven following the rotation of the driving roller 9, and a belt 11 to be laid between these pulleys 10*a* and 10*b*.

The pulleys 10*a* and 10*b* are belt pulleys for supporting the belt to transmit the driving force. Projections or crevices may be formed on the contact surfaces on the pulleys 10*a* and 10*b* with the belt or the pulleys 10*a* and 10*b* may be provided with a member with high coefficient of friction.

The pulleys 10*a* and 10*b* and the belt 11 contribute to a reliable transmission of the driving force of the driving roller 9 to the rotating axis of the guide roller 7A, and to carry out this action if the driving source were mounted at the rotating axis of the guide roller 7A. Therefore, the rotating speeds of the driving roller 9, and the guide rollers 7A and 7B are all made identical.

In this case, it is possible to synchronize the rotation of guide roller 9 and that of the guide roller 7A by making the diameters of the driving rollers and that of the guide roller 7A the same.

The belt mechanism may be replaced with a timing belt mechanism. The timing belt mechanism is composed of a belt pulley with grooves or teeth formed at a fixed interval and a belt with projections at the rear surface so as to be in gear with the grooves or teeth.

Such a timing belt mechanism can execute reliable transmission of the rotation driving force of the driving roller 9 to the guide roller 7A, through the gear grooves formed on the rotation axis, and the rear projections of the belt which engage with the grooves.

Accordingly, the rotating speed of the driving roller 9 and the rotating speed of the guide roller 7A can be equalized accurately and the feeding speed of the belt-shaped photosensitive body 2 by the driving roller 9 coincides with the driving speed of the guide roller 7A by the belt-shaped photosensitive body 2. Thereby, the driving force generated by one driving source can be transmitted to the driving roller 9 and the guide roller 7A simultaneously, and the transfer speed of the belt-shaped photosensitive body 2 can be maintained at a fixed value over the total length.

By the above described structure, the guide roller 7A is driven following the driving roller 9 at the same driving speed of the driving roller 9 by driving the belt-shaped photosensitive body 2.

Intermediate transfer roller 6, which is in contact with the photosensitive body 2 and which, along with fixing roller 8 comprise the fixing device are also driven, so that the recording medium P is transported in the b direction and the images are formed.

Figure 3:
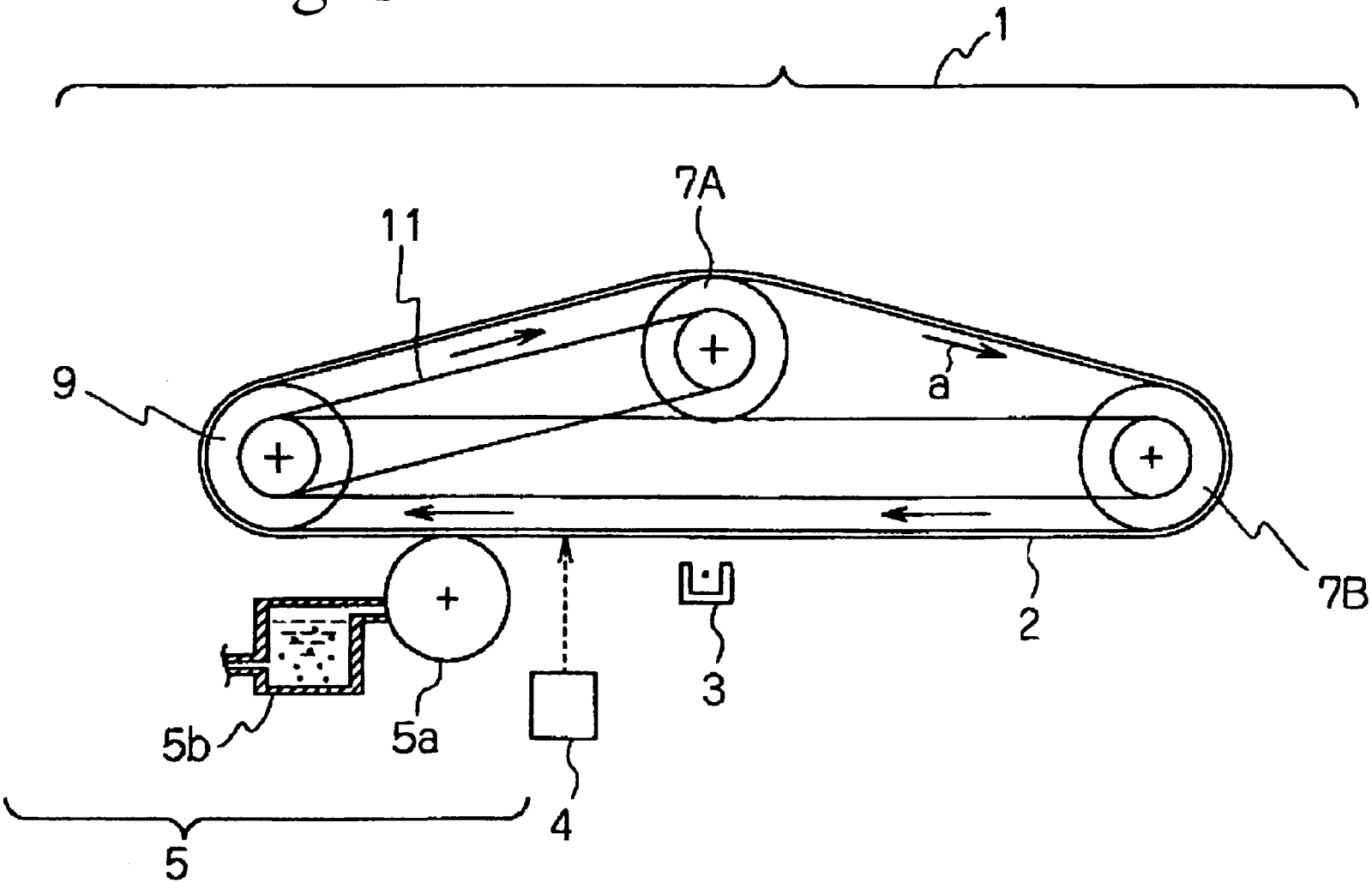
FIG. 3 is a cross sectional view showing the belt-shaped photosensitive body in an image forming apparatus according to another embodiment of the present invention.

Another embodiment is shown in FIG. 3. According to this embodiment, two guide rollers are disposed at a specified interval and a plurality of belt mechanisms are provided for transmitting the rotation force of the driving roller 9 to respective guide rollers 7B.

The guide rollers 7B connected to the driving roller 9 by means of the belt mechanisms feed the photosensitive body 2 at the same feeding speed as the driving roller 9. By providing two belt mechanisms for respective guide rollers 7A and 7B, it is possible to more uniformly equalize the transfer speed of the photosensitive body 2 at every location.

The transfer speed of the endless belt-type photosensitive body 2 propelled by the same driving forces at a plurality of positions is equalized at every location.

Individual latent images and visual images composed of respective color images and compiling images formed on the photosensitive body 2 are overlapped without displacement, which results in providing high quality images.

Figure 4:
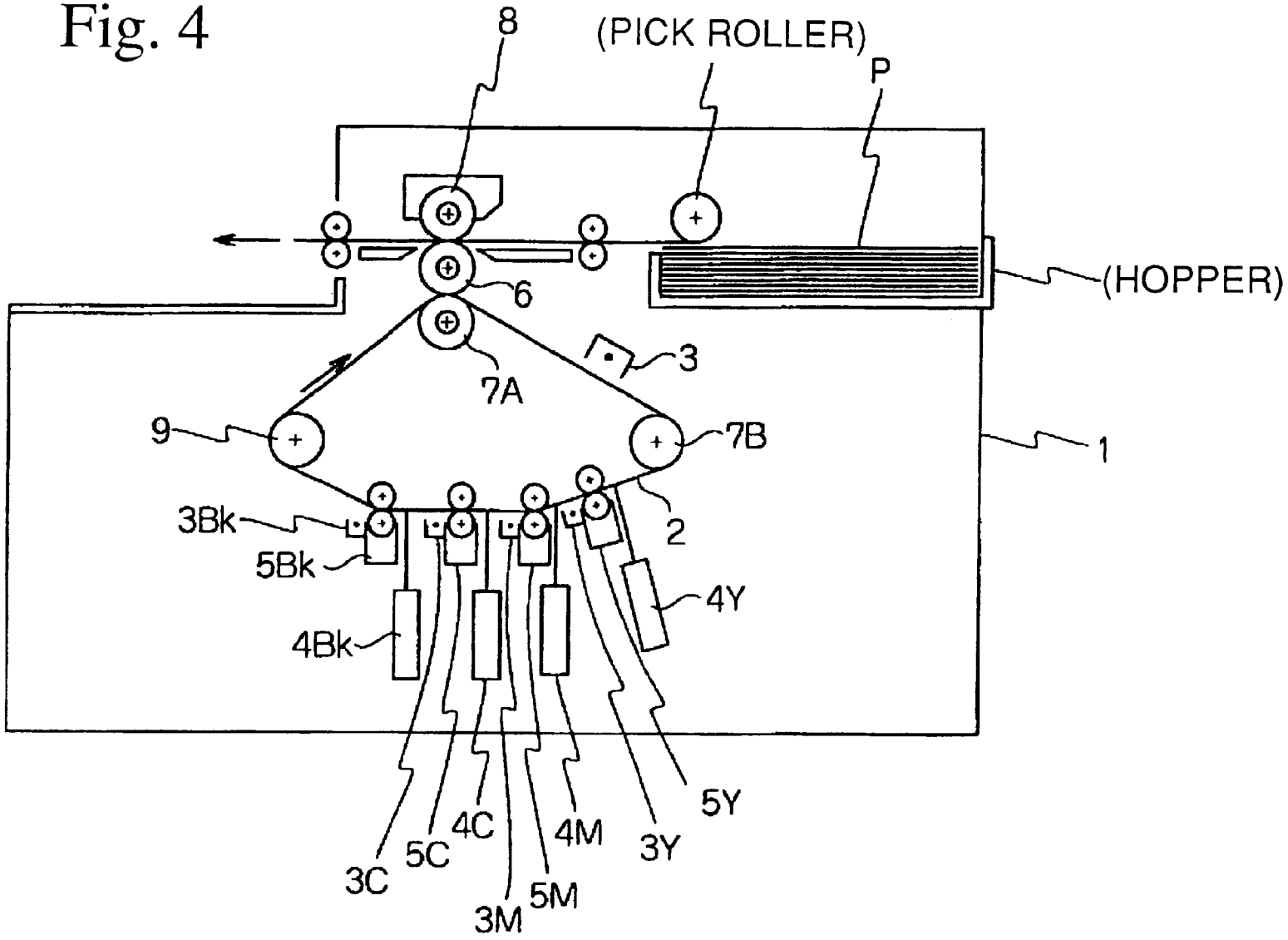
FIG. 4 is a cross sectional view showing a color image forming apparatus according to an embodiment of the present invention.

FIG. 4 is a cross sectional diagram showing an image forming apparatus 1 as a whole according to one embodiment of the present invention, and the image forming apparatus is a color image forming apparatus 1 using electrophotography.

The image forming machine 1 is provided with an endless belt-shaped photosensitive body 2, which comprises an electrifier 3 for electrifying the belt-shaped photosensitive body 2; four sets of exposure devices for forming respective color electrostatic latent images such as 4Y (for yellow), 4M (for magenta), 4C (for cyan), and 4Bk (for black); and four sets of development devices for producing respective visible color images such as 5Y, 5M, 5C, and 5Bk.

The device fixing means including transfer aid roller 8 and an intermediate transfer roller 6 is provided in the middle of the traveling path of the photosensitive body 2.

The recording medium for recording images is stored in a container, and is delivered by a pick-roller.

When images are formed, the photosensitive body 2 is charged at a predetermined potential by the electrifier 3, and a latent image corresponding to a yellow latent image is formed by the yellow exposure device 3Y The yellow toner is stored in the yellow development device 5Y, and a yellow image is developed by supplying the yellow toner to the photosensitive body 2.

Subsequently, exposure and development are repeated five times for producing respective images of magenta, cyan, and black colors and these color images are overlapped on the yellow image and a full color image is produced on the photosensitive body 2.

In the formation of color images by the image forming apparatus 1 of the present invention, since the photosensitive body 2 is transferred uniformly as a whole, the images of yellow, magenta, cyan, and black colors overlap the designated position without any displacements with respect to each other, and high quality color images are obtained.

As described above, the image forming apparatus of the present invention is provided with a transmission means such as the belt mechanism or the gear mechanism which transmit the rotating force of the driving roller which is in contact with the rear surface of the belt-shaped photosensitive body to the designated guide rollers, for rotating the guide rollers at the same speed as the driving roller, so that it is possible to rotate the guide roller at the same speed as the driving roller and it is also possible to synchronize the rotation of the guide roller and the rotation of the driving roller.

Thereby, the transfer speed of the photosensitive belt imparted by the driving roller is identical to that imparted by the belt-driven drive roller so that the transfer speed of the photosensitive belt is maintained constant over its whole length, and even monochromic color images for forming the color image or the latent images or the visual images for forming compiled images overlap without displacement, and high image quality can be obtained.

By providing the pulley and belt as the belt mechanism, the rotation driving force of the driving roller is transmitted to the rotating axis of the guide roller securely, so that it is possible to make the rotation speed of the guide roller coincide with that of the driving roller, such that the photosensitive body in contact with these rollers can be transferred at the same speed.

When the timing belt mechanism is used as the belt mechanism, the rotation driving force of the driving roller is transmitted accurately to the guide roller through the gear teeth formed on the rotating axis and grooves formed on the rear surface of the photosensitive belt engaged with those gear teeth, so that the speed of the driving roller coincides with that of the guide roller, and the transfer speed of the photosensitive body by the driving roller is made coincide with the rotating speed of the guide roller by the photosensitive body.

Accordingly, it becomes possible to transmit the rotating force generated by one driving source to the driving roller and the guide roller simultaneously, and it is possible to maintain the transfer speed of the photosensitive body constant over the entire length of the photosensitive body.

A particular arrangement of the driving rollers and two guide rollers is adopted, in which a guide roller from a plurality of guide rollers is disposed on the same horizontal plane as the driving roller, and another guide roller is disposed at an intermediate high position between the driving roller and said first roller, equidistant from the driving roller and said first guide roller. The above arrangement can provide a large horizontal portion of the photosensitive body to which the development rollers or other devices can be attached, in addition to providing stable transfer of the photosensitive body.

In a certain arrangements of the guide rollers, the contact area of the guide rollers with the photosensitive body becomes small. Since the contact area of the guide rollers is small, there is a chance that the photosensitive body will slip, causing an uneven transfer speed. By applying force directly to the guide roller, such slippage is avoided.

In the embodiment in which two belt mechanisms are rollers, even more accurate rollers, which are disposed separated by a designated space. Equalization of the transfer speed of the photosensitive body over the entire length can be achieved.

It should be understood that while the invention has been described in the content of specific and preferred embodiments, the invention is not restricted by such embodiments and the scope thereof is defined by the appended claims.

What is claimed is:

1. An image forming apparatus comprising:

an endless belt-shaped photosensitive body having an inner surface and an outer surface;

an electrifier which applies an electric charge to the photosensitive body;

an exposure device which forms electrostatic latent images on the electrified photosensitive body;

a development device which forms visible images on the photosensitive body based on the electrostatic latent images; and a fixing device which transfers the visible images on the photosensitive body to a recording medium;

a driving roller in contact with the inner surface of the photosensitive body;

a first guide roller for guiding the photosensitive body;

a second guide roller spaced apart from the first guide roller;

a first belt for transmitting rotational force from the driving roller to the first guide roller; and a second belt for transmitting rotational force from the driving roller to the second guide roller.

2. An image forming apparatus according to claim 1 in which the second guide roller is so positioned that the portion of the photosensitive body between the second guide roller and the driving roller is disposed in a horizontal plane.

3. An image forming apparatus according to claim 2 in which the first guide roller is positioned between and above the driving roller and the second roller, and equidistant from the driving roller and the second guide roller.

4. An image forming apparatus according to claim 3 in which the diameters of the driving roller and the first and second guide rollers are equal.

5. An image forming apparatus according to claim 1 in which the fixing device includes at least one fixing roller in contact with the inner surface of the photosensitive belt, the fixing roller having its axis of rotation in vertical alignment with the axis of rotation of the first guide roller.

* * * * *